United States Patent [19]

Whitaker

[11] 3,990,121

[45] Nov. 9, 1976

[54] BOX SPRING ASSEMBLY

[75] Inventor: James P. Whitaker, Memphis, Tenn.

[73] Assignee: Lear Siegler, Inc., Santa Monica, Calif.

[22] Filed: Sept. 17, 1975

[21] Appl. No.: 614,719

[52] U.S. Cl. ..... 5/260; 5/267; 267/107

[51] Int. Cl.[2] ..... A47C 23/04

[58] Field of Search ..... 5/247, 248, 259 R, 260, 5/265–267, 351, 354; 267/89, 93, 102–109, 110

[56] References Cited

UNITED STATES PATENTS

| | | | |
|---|---|---|---|
| 2,728,381 | 12/1955 | Conrad | 5/265 |
| 3,082,436 | 3/1963 | Rymland | 5/259 |
| 3,833,948 | 7/1974 | Surletta et al. | 5/247 |
| 3,916,463 | 11/1975 | Higgins | 5/246 |

*Primary Examiner*—Casmir A. Nunberg
*Attorney, Agent, or Firm*—Reising, Ethington, Barnard, Perry and Brooks

[57] ABSTRACT

A generally rectangular box spring assembly of the disclosure includes a wire grid supported on a lower frame by center coil springs and by formed wire springs at the edge of the assembly. The formed wire springs provide relatively firm edge support while the coil springs provide softer center support. Each of the formed wire springs includes at least one fishmouth section extending upwardly from an associated frame member for connection to the grid. The formed wire springs preferably include a pair of the fishmouth sections which are interconnected by a connecting portion. The grid may be secured to the connecting portion of the formed wire springs or to a border wire that is itself secured to the fishmouth sections of these springs. The center coil springs are preferably of a conical shape with their smaller ends secured to laterally extending frame slats and with their larger ends clipped to the wire grid. The coil springs supported by each slat are preferably secured thereto by a wire associated with each slat as well as by crossing wires extending between the slats.

9 Claims, 4 Drawing Figures

BOX SPRING ASSEMBLY

BACKGROUND OF THE INVENTION

1. Field of the Invention

The present invention relates to box spring assemblies particularly adapted for supporting bed mattresses.

2. Description of the Prior Art

Conventional prior art bedding box spring assemblies have included coil springs extending in a vertical orientation so as to provide resilient support of a bedding mattress. These known box spring assemblies have also included formed wire springs for supplying the required vertical resilient support. This latter type of box spring assembly incorporating formed wire springs is shown by U.S. Pat. Nos. 3,825,960; 3,833,948 and 3,835,485, all of which are assigned to the assignee of the present invention. The formed wire springs of these patented box spring assemblies each include at least one fishmouth section extending upwardly from a lower frame of the assembly. Usually each such spring has a pair of the fishmouth sections which are interconnected by a connecting portion of the spring. Each fishmouth section has cantilever portions that are connected by generally right-angle bends to combined cantilever and torsion bar portions. These formed wire springs may be mounted in an isolated, non-contacting relationship with respect to each other but usually are interconnected by suitable wires so as to cooperate in providing a relatively firm box spring assembly. This type of formed wire spring is usually much firmer than the coil type of spring previously mentioned.

SUMMARY OF THE INVENTION

The present invention is directed toward an improved rectangular box spring assembly having relatively firm edge support but somewhat softer center support. The firmer edge support is provided by a plurality of formed wire springs mounted on a lower frame of the assembly and the softer center support is provided by coil springs that extend upwardly from lateral slats of the frame. A wire grid rests on top of the center coil springs and is connected to the edge formed wire springs so as to interconnect the spring action of these springs.

The formed wire springs must each have at least one fishmouth section extending upwardly from the frame and preferably have two fishmouth sections which are interconnected by a connecting portion. The wire grid is disclosed as being clipped directly to the connecting portion of the formed wire springs located at the ends of the assembly. At the lateral sides of the assembly, the wire grid is disclosed as being connected to a border wire of the assembly and the border wire is clipped to the fishmouth sections of the adjacent formed wire springs as well as to the fishmouth sections of the formed wire springs at the ends of the assembly.

The coil springs of the assembly have conical configurations with their smaller ends supported on the laterally extending slats of the frame and with their larger ends supporting the wire grid. The coil springs associated with each slat preferably have their smaller ends secured thereto by an associated wire extending along each slat and by a plurality of crossing wires extending between the slats. The larger upper ends of the coil springs are secured to the wire grid by clips positioned at diametrically opposed portions of their upper end coils.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
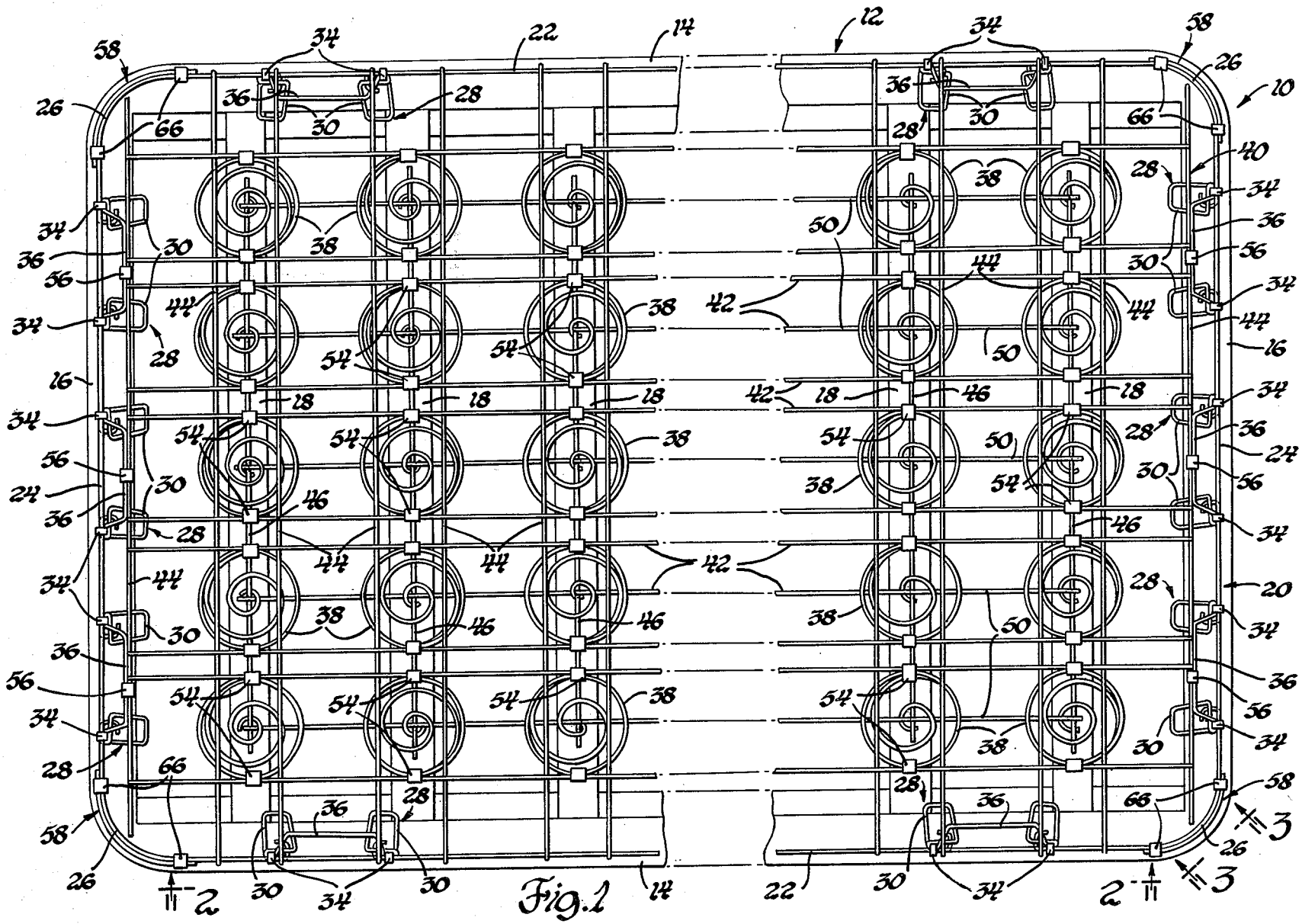
FIG. 1 is a top plan view of a box spring assembly embodying the present invention.

In FIG. 1, a box spring assembly embodying the present invention is indicated generally by reference numeral 10 and has a rectangular configuration so as to be capable of supporting a rectangular bedding mattress in the usual fashion. The box spring assembly includes a lower wooden frame 12 of a generally rectangular configuration. This frame includes wooden side and end member 14 and 16, respectively, as well as a plurality of wooden slats 18 extending laterally between and suitably supported by the side frame members. Of course, other suitable materials, such as steel, etc. could be utilized to make the frame. A border wire 20 of the assembly has a generally rectangular configuration and includes side and end portions respectively indicated by numerals 22 and 24. The corners 26 of the border wire are preferably rounded as are the junctures between the side and end members of the lower frame 12.

Figure 2:
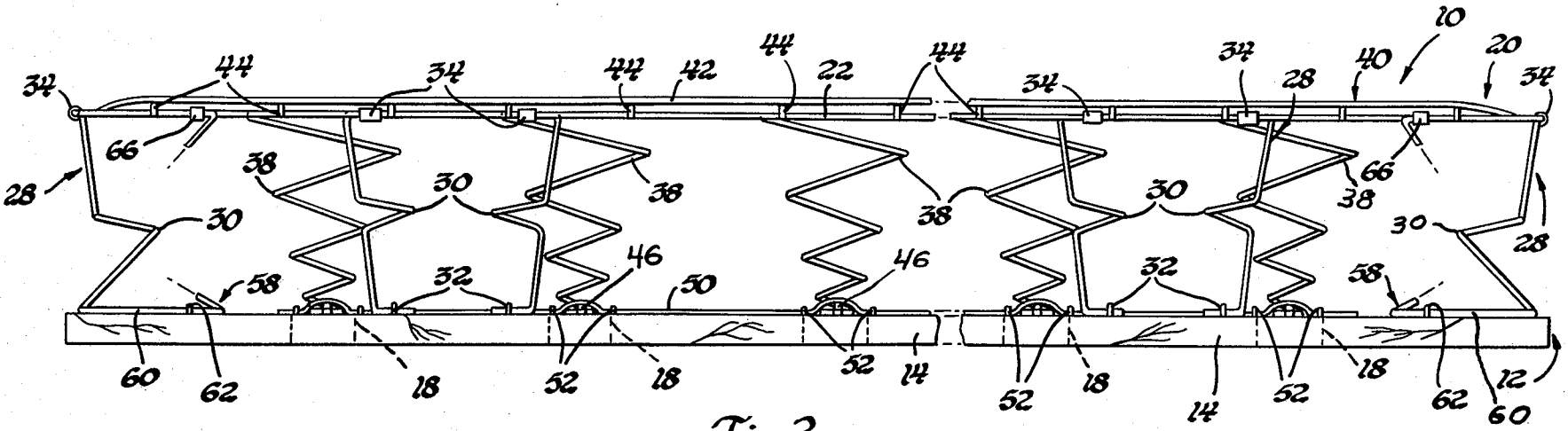
FIG. 2 is a side elevation view of the box spring assembly taken along line 2—2 of FIG. 1.

With combined reference to FIGS. 1 and 2, each side and end portion of the border wire 20 is suitably supported by a plurality of formed wire springs 28. Preferably, there are three such springs associated with each end of the assembly and four such springs associated with each of its sides. These formed wire springs each include a pair of fishmouth sections 30 extending vertically between the adjacent frame member and border wire portion so as to space the border wire above the frame. The lower ends of the fishmouth sections are suitably secured to the associated frame member such as by staples 32, FIG. 2, while the upper ends are suitably secured to the associated border wire portion by clips 34. The fishmouth sections of each formed wire spring are interconnected by a connecting portion 36 that has a flattened generally U-shaped configuration, FIG. 1. The connecting portion 36 of each spring extends inwardly from the border wire and interconnects the spring action of its two fishmouth sections so that their cooperative action provides a relatively firm edge support to the assembly at the border wire.

As also seen by combined reference to FIGS. 1 and 2, a plurality of coil springs 38 are supported by each laterally extending frame slat 18 and extend upwardly so as to cooperatively support a wire grid 40. The wire grid includes longitudinally extending wires 42 as well as laterally extending wires 44. These wires 42 and 44 are preferably welded to each other at their crossing junctures and are connected to the border wire 20 so that the formed wire springs 28 and the coil springs 38 cooperatively provide a resilient spring action to the assembly. The formed wire springs are relatively firm and give the assembly a relatively firm edge support while the coil springs are somewhat softer and provide somewhat softer center support to the assembly.

Figure 4:
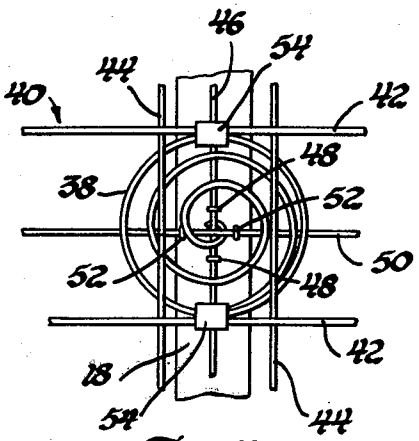
FIG. 4 is an enlarged view of a portion of FIG. 1.

The coil springs 38 of the assembly have conical configurations, FIG. 2, with their smaller ends secured to the associated frame slat 18 and with their larger ends supporting the wire grid 40. As seen in FIGS. 1 and 4, a plurality of laterally extending wires 46 are respectively associated with the frame slats 18 and extend over the lower ends of the coil springs 38 supported by the associated slat with staples 48 positioning the wire on the slat so as to secure the spring to the frame. Additionally, a plurality of wires 50 extend longitudinally with respect to the assembly and also pass over the lower ends of the coil springs as well as crossing over the lateral wires 46. As seen in FIG. 4, staples 52 position the longitudinal wires 50 with respect to the slats so as to retain the coil springs in place in a cooperable manner with the lateral wires 46. The lower ends of the coil springs are thus securely positioned with respect to the wooden frame so their larger upper ends are capable of supporting the wire grid 40. As seen by particular reference to FIGS. 1 and 4, clips 54 provides suitable means for securing the upper coil of each coil spring 38 to the longitudinal wires 42 of the grid. The clips are located at diametrically opposed locations. Of course, the coil springs could also be secured to the grid by having its upper coil positioned above certain of the gird wires and below other grid wires so as to be locked therebetween.

As seen in FIGS. 1 and 2, the lateral wires 48 of the wire grid 40 have their ends directly connected to the side portions 22 of the border wire. This direct connection is preferably accomplished by suitable welds or by forming the wire ends with hook-shaped configurations about the side border wire portions 22. The end portions 24 of the border wire are indirectly connected to the wire grid 40 through adjacent formed wire springs 28. Clips 56, FIG. 1, secure the inner closed ends of the U-shaped connecting portions 36 of the formed wire springs to the lateral wires 44 of the grid at each of its longitudinal ends to provide this indirect connection. The ends of the wire grid extend downwardly to a slight degree, as seen in FIG. 2, to permit this securement.

Figure 3:
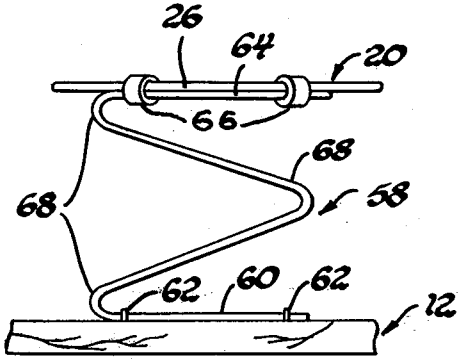
FIG. 3 is an elevation view of one of the corners of the box spring assembly taken along line 3—3 of FIG. 1.

Each corner 26 of the border wire 20 is preferably supported on the frame 12 by an associated auxiliary spring 58 as shown in FIG. 3. Each auxiliary spring 58 has a lower leg 60 secured to the frame by staples 62 as well as an upper leg 64 secured to the border wire corner by clips 66. The auxiliary springs define V-shaped portions 68 that open in a sideways direction so that these springs cooperate with the formed wire springs 28 in providing the relatively firm edge support for the border wire.

While a preferred embodiment of the box spring assembly has herein been described in detail, those skilled in the art will recognize various alternative constructions and designs for practicing the present invention as described by the following claims.

What is claimed is:

1. A box spring assembly comprising the combination of: a generally rectangular lower frame having side and end members defining the periphery of the assembly; said frame also including slats extending laterally between the side members; a plurality of formed wire springs supported by each side and end member of the frame; each of said formed wire springs including at least one fishmouth section extending upwardly at the periphery of the assembly from the associated frame member; a plurality of coil springs mounted on the frame slats and extending in an upward direction therefrom; said coil springs being located within the confines of the assembly periphery defined by the side and end frame members which support the fishmouth sections of the formed wire springs; and a wire grid supported on top of the coil springs and connected with the upwardly extending formed wire springs so the formed wire springs provide relatively firm edge support to the assembly while the coil springs provide somewhat softer center support.

2. A box spring assembly as in claim 1 wherein the coil springs have conical configurations whose smaller ends are mounted on the slats and whose larger ends support the grid.

3. A box spring assembly as in claim 2 wherein the smaller ends of the springs mounted on each slat are secured thereto by a wire associated with each slat and by crossing wires extending between the slats.

4. A box spring assembly as in claim 1 and also including a rectangular border wire that is connected to both the wire grid and the formed wire springs.

5. A box spring assembly as in claim 1 wherein each formed wire spring includes a pair of the fishmouth sections and a connecting portion that interconnects the fishmouth sections.

6. A box spring assembly as in claim 5 wherein the wire grid is secured to at least some of the formed wire springs by clips at the connecting portions of these springs.

7. A box spring assembly as in claim 5 which also includes a border wire that is connected to the fishmouth sections of the formed wire springs and to certain portions of the grid to provide the connection between these grid portions and the adjacent formed wire springs.

8. A box spring assembly as in claim 1 and including means for securing the upper ends of the coil springs to the wire grid.

9. A box spring assembly comprising the combination of: a generally rectangular lower frame having side and end members defining the periphery of the assembly; said frame also including slats extending laterally between the side members; a plurality of formed wire springs mounted on each side and end member of the frame; each of said formed wire springs including a pair of fishmouth sections extending upwardly at the periphery of the assembly from the associated frame member as well as a generally flattened U-shaped connecting portion interconnecting the fishmouth sections; a plurality of conical shaped coil springs whose smaller ends are mounted on the frame slats with their larger ends extending upwardly; said coil springs being located within the confines of the assembly periphery defined by the side and end frame members which support the fishmouth sections of the formed wire springs; and a wire grid mounted on top of the coil springs and connected with the formed wire springs so as to provide an assembly with relatively firm edge support due to the formed wire springs but somewhat softer center support due to the coil springs.

* * * * *